US006850014B2

(12) United States Patent
Yeh et al.

(10) Patent No.: US 6,850,014 B2
(45) Date of Patent: Feb. 1, 2005

(54) DISCHARGE LAMP CIRCUIT FOR IGNITION TIME CONTROL AND OVERVOLTAGE PROTECTION RECEIVERS

(75) Inventors: Chia-Chih Yeh, Jungli (TW); Yung-Yi Hsu, Taipei (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/615,169

(22) Filed: Jul. 7, 2003

(65) Prior Publication Data

US 2004/0032224 A1 Feb. 19, 2004

(30) Foreign Application Priority Data

Aug. 9, 2002 (TW) ..... 91117957 A

(51) Int. Cl.[7] ..... H05B 37/02

(52) U.S. Cl. ..... 315/209 R; 315/308; 315/360; 315/DIG. 7

(58) Field of Search ..... 315/209 R, 224–225, 315/209 T, 209 CD, 291, 307, 308, 360, DIG. 5, DIG. 7

(56) References Cited

U.S. PATENT DOCUMENTS 4,665,346 A * 5/1987 Tarroux ..... 315/289
4,914,356 A * 4/1990 Cockram ..... 315/307
5,068,570 A * 11/1991 Oda et al. ..... 315/128
5,070,279 A * 12/1991 Garbowicz et al. ..... 315/289
5,781,418 A * 7/1998 Chang et al. ..... 363/16
6,008,590 A * 12/1999 Giannopoulos et al. . 315/209 R
6,160,362 A * 12/2000 Shone et al. ..... 315/209 R
6,194,842 B1 * 2/2001 Canova ..... 315/225

* cited by examiner

*Primary Examiner*—Thuy Vinh Tran
(74) *Attorney, Agent, or Firm*—Ladas & Parry LLP

(57) ABSTRACT

A discharge lamp circuit for ignition time control and overvoltage protection. The discharge lamp circuit includes drive circuitry, a sensing circuit, a timing circuit and a start-up circuit. The drive circuitry produces a strike voltage for a discharge lamp and provides a lamp current through the discharge lamp. The sensing circuit is provided to detect the lamp current. During lamp start-up, the timing circuit will develop a threshold voltage at the end of a predetermined period if the discharge lamp has not been lit yet, thereby controlling an ignition time of the drive circuitry. The start-up circuit allows the drive circuitry to keep on applying the strike voltage for the ignition time in order to start the discharge lamp before the threshold voltage is developed. Once the sensing circuit detects the absence of the lamp current, the start-up circuit also causes the drive circuitry shutdown.

20 Claims, 2 Drawing Sheets

DISCHARGE LAMP CIRCUIT FOR IGNITION TIME CONTROL AND OVERVOLTAGE PROTECTION RECEIVERS

BACKGROUND OF THE INVENTION

1. Field of the Invention

The invention relates to circuitry for driving discharge lamps, and more particularly to circuitry for use in a liquid crystal display (LCD) backlight.

2. Description of the Related Art

There has been an ever-increasing demand for LCD displays within the past few years. Such displays are being employed by all types of computer devices including flat display monitors, personal wireless devices and organizers, and large public display boards. Typically, LCD panels utilize a backlighting arrangement which includes a discharge lamp that provides light to the displayed images. Among those currently available discharge lamps, cold cathode fluorescent lamps (CCFLs) provide the highest efficiency for backlighting the display. These CCFLs require high voltage AC to operate, mandating an efficient high voltage DC/AC inverter.

Although the operating voltage of the CCFL is typically of the order of some hundreds of Volts, a higher voltage is required initially to light up the CCFL. The lamp voltage required to ignite the CCFL is called the strike voltage or kick-off voltage. It is approximately 2~3 times the CCFL operating voltage, for instance, the strike voltage may be up to 1500 volts. After applying the strike voltage, the CCFLs have some amount of delay time depending on their respective characteristics. In general, a CCFL inverter keeps on applying the strike voltage to the lamp for several seconds until discharge, and this period is commonly referred to as the ignition time. However, "open" or broken lamps can cause full voltage to appear at the output of a conventional CCFL inverter without overvoltage protection. For example, if a huge voltage, i.e., an overvoltage condition occurs, across the inverter's output terminals when the conventional CCFL inverter is turned on without the CCFL being in place, or when the CCFL becomes disconnected during normal operation due to a contact failure. This presents a safety hazard when touching or replacing the lamp. Further, the overvoltage condition can damage components of the CCFL inverter, and/or cause the inverter to run into an unexpected state, and eventually cause the inverter to be damaged.

SUMMARY OF THE INVENTION

It is an object of the present invention to provide a discharge lamp circuit capable of control of ignition time for different discharge lamps.

It is another object of the present invention to provide a discharge lamp circuit capable of causing CCFL-drive circuitry shutdown to protect against the overvoltage condition.

It is yet another object of the present invention to provide a display having functions of ignition time control and overvoltage protection.

The present invention is generally directed to a discharge lamp circuit for ignition time control and overvoltage protection. According to one aspect of the invention, the discharge lamp circuit includes drive circuitry to produce a strike voltage for a discharge lamp and provide a lamp current through the discharge lamp. Also, the discharge lamp circuit of the invention includes a sensing circuit, a timing circuit and a start-up circuit. The sensing circuit is used to detect the lamp current. Under control of the sensing circuit, the timing circuit can develop a threshold voltage at the end of a predetermined period such that an ignition time of the drive circuitry is controlled. To start the discharge lamp before the threshold voltage is developed, the start-up circuit allows the drive circuitry to keep on applying the strike voltage for the ignition time. If the sensing circuit detects the absence of the lamp current, the start-up circuit causes the drive circuitry shutdown.

In one embodiment of the invention, the timing circuit is comprised of a resistor and a capacitor. The capacitor is coupled to the resistor at a node where a node voltage can be developed. The node voltage can reach the threshold voltage at the end of the predetermined period that is determined by the capacitor's value and the resistor's value. The start-up circuit includes a first transistor coupled to the node of the timing circuit, and the sensing circuit includes a second transistor coupled to the capacitor of the timing circuit. The start-up circuit receives an input signal and provides a start signal. When a voltage difference between the input signal and the node voltage is sufficient to drive the first transistor into a first state, the start-up circuit generates the start signal at a first level to activate the drive circuitry. If the drive circuitry succeeds in striking the discharge lamp, the sensing circuit detects the presence of the lamp current and the second transistor is in the first state to discharge the capacitor of the timing circuit. If a backlight inverter is turned on without the discharge lamp being in place, or if the lamp becomes disconnected during normal operation due to a failure, the sensing circuit detects the absence of the lamp current and thus the second transistor becomes a second state. This allows the capacitor to be charged so that the node voltage reaches the threshold voltage at the end of a predetermined period. Consequently, the voltage difference between the input signal and the node voltage drives the first transistor into the second state, and the start-up circuit generates the start signal at a second level to shut down the drive circuitry in order to prevent the occurrence of the overvoltage condition. Furthermore, the start-up circuit includes a third transistor coupled to the capacitor to discharge the capacitor quickly upon the drive circuitry shutdown.

DESCRIPTION OF THE DRAWINGS

The present invention will be described by way of exemplary embodiments, but not limitations, illustrated in the accompanying drawings in which like references denote similar elements, and in which.

DETAILED DESCRIPTION OF THE INVENTION

Figure 1:
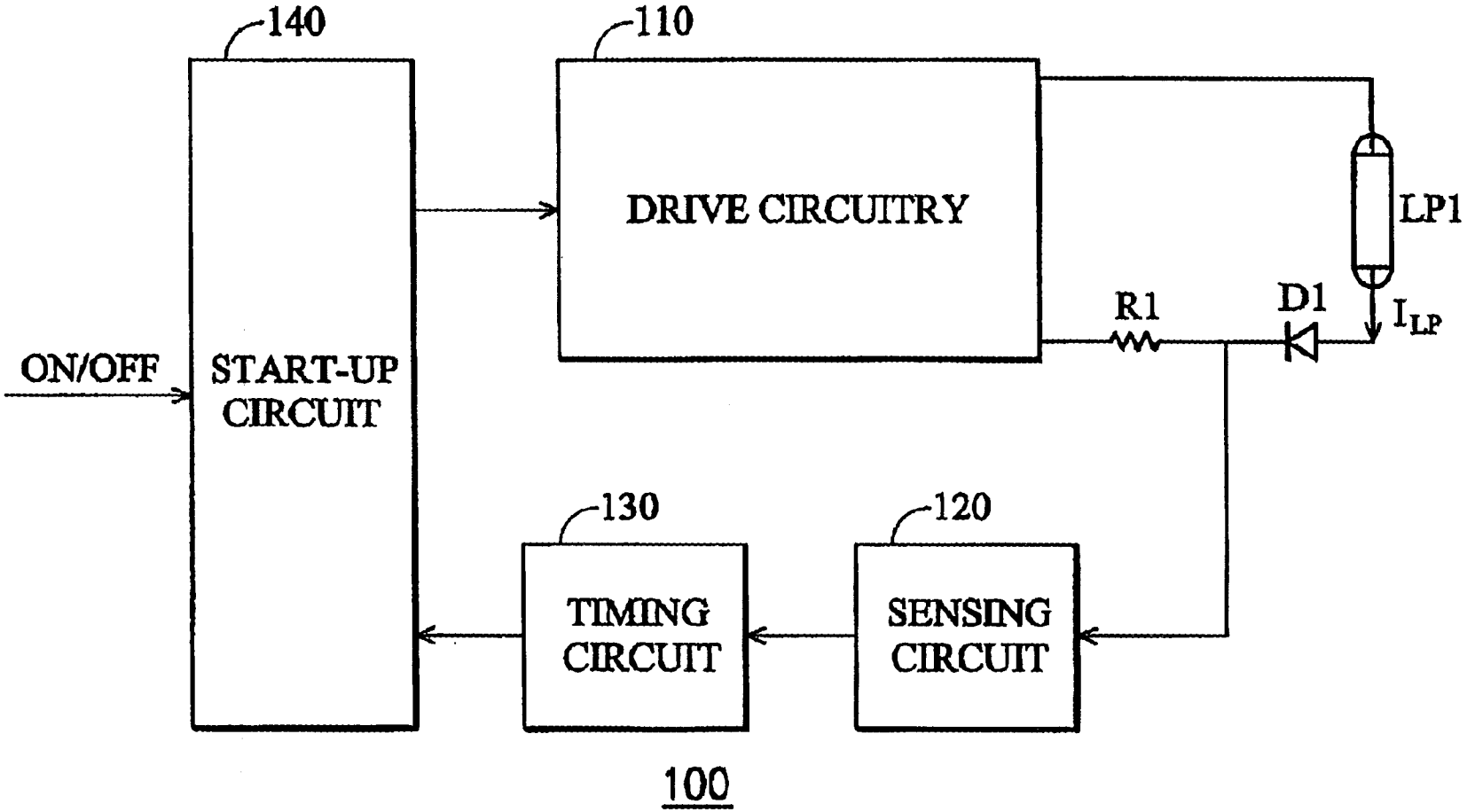
FIG. 1 is a block diagram illustrating a discharge lamp circuit according to the invention.

With reference to FIG. 1, a discharge lamp circuit 100 of the invention includes drive circuitry 110 to produce a strike voltage for a cold cathode fluorescent lamp (CCFL) LP1 and provide a lamp current $I_{LP}$ through the lamp LP1. As depicted, a diode D1 and a resistor R1 connected in series with the lamp LP1 provide the lamp current $I_{LP}$ as feedback to the drive circuitry 110. The discharge lamp circuit 100 also includes a sensing circuit 120, a timing circuit 130 and a start-up circuit 140. The sensing circuit 120 is coupled to the lamp LP1 through the diode D1 to detect the lamp current $I_{LP}$. The timing circuit 130 is coupled to the sensing circuit 120 to adjust and determine a period $T_{ON}$. Under control of the sensing circuit 120, the timing circuit 130 can develop a threshold voltage $V_{REF}$ at the end of the predetermined period $T_{ON}$, thereby controlling an ignition time of the drive circuitry 110. The start-up circuit 140 is coupled to the drive circuitry 110 and the timing circuit 130, separately. To ignite the lamp LP1 before the threshold voltage $V_{REF}$ is developed, the start-up circuit 140 allows the drive circuitry 110 to keep on applying the strike voltage for the ignition time. If the sensing circuit 120 still detects the absence of the lamp current $I_{LP}$ when the period $T_{ON}$ has elapsed, the timing circuit 130 will develop the voltage $V_{REF}$, leading the start-up circuit 140 to cause drive circuitry 110 shutdown.

Figure 2:
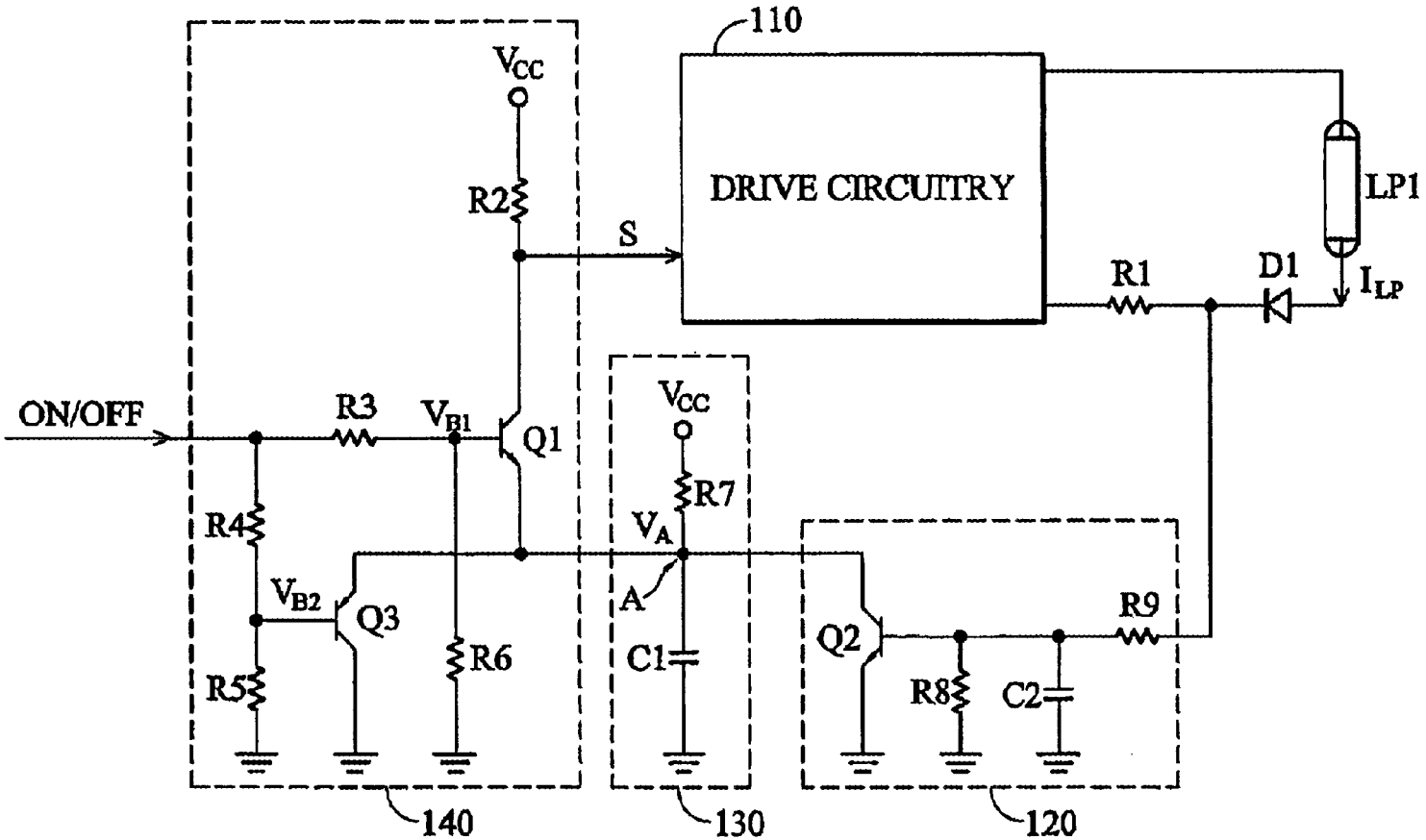
FIG. 2 is a schematic diagram illustrating a preferred embodiment of the invention.

Turning now to FIG. 2, a schematic diagram of a preferred embodiment is illustrated. Note that the LCD backlight module (not shown) incorporating the discharge lamp circuit 100 is powered by a power supply Vcc. Switches Q1, Q2 and Q3 in FIG. 2 are either a bipolar junction transistor (BJT) or a metal-oxide-semiconductor (MOS) transistor. In this embodiment, these switches are illustrated with BJTs for example. As depicted, a NPN transistor Q2, a capacitor C2 and resistors R8, R9 form the sensing circuit 120. When the sensing circuit 120 detects the current $I_{LP}$ flowing through the lamp LP1, it develops a base voltage across the resistor R8 sufficiently to bring about conduction in the transistor Q2, i.e., the transistor Q2 is turned on. Conversely, when the sensing circuit 120 detects the absence of the lamp current $I_{LP}$, there is no current to form a voltage drop across the resistor R8 and the transistor Q2 is thus turned off, i.e., the transistor Q2 is said to be in a non-conductive state. The timing circuit 130 is made up of a capacitor C1 and a resistor R7. One terminal of the resistor R7 is coupled to the power supply Vcc and the other terminal of the resistor R7 is coupled to the capacitor C1 at a node A where a node voltage $V_A$ can be developed. In addition, the capacitor C1 is coupled across the transistor Q2's collector and emitter. If the transistor Q2 is in the non-conductive state, this permits the capacitor C1 to be charged such that the node voltage $V_A$ reaches $V_{REF}$ at the end of the period $T_{ON}$. Therefore, the period $T_{ON}$ can be determined by the capacitor C1's value and the resistor R7's value.

The start-up circuit 140 includes a NPN transistor Q1 and a PNP transistor Q3. The transistors Q1 and Q3 have their emitters connected in common to the node A of the timing circuit 130. The collector of Q1 is coupled to Vcc through a resistor R2, while the collector of Q3 is coupled to the ground. The base of Q1 is connected to a voltage divider formed with resistors R3 and R6 to receive an input signal ON/OFF. Likewise, the base of Q3 is connected to another voltage divider formed with resistors R4 and R5 to receive the input signal ON/OFF. Upon power-up, the ON/OFF signal is at a logic high level (logic "1"). Until the lamp LP1 is struck, the sensing circuit 120 detects no current through the lamp LP1. Consequently, the transistor Q2 is made non-conductive so that the capacitor C1 begins charge from zero. During the period $T_{ON}$, a voltage difference between the ON/OFF signal and the node voltage $V_A$ is sufficient to turn on the transistor Q1. The resistors R3 and R6 divide the ON/OFF signal's voltage into a voltage $V_{B1}$ (base voltage) at the base of Q1. In other words, the voltage drop across the base and emitter of Q1 equivalent to the voltage difference $V_{B1}-V_A$ is high enough to bring about conduction in the transistor Q1, i.e., the voltage difference $V_{B1}-V_A$ drives the transistor Q1 into saturation before the node voltage $V_A$ rises to $V_{REF}$. Consequently, the collector of Q1 produces a start signal S at a logic low level (logic "0"), and the drive circuitry is thus activated by the start signal of logic "0" to output the strike voltage to the lamp LP1. The drive circuitry 110 can keep on applying the strike voltage for the ignition time ($T_{ON}$) as long as the voltage difference $V_{B1}-V_A$ is still sufficient to turn on the transistor Q1. The component values of R3 and R6 are selected to set the transistor Q1's base voltage $V_{B1}$. The charge time for the capacitor C1 is determined by the component values of R7 and C1. Therefore, it is useful to adjust the aforementioned component values to control the ignition time, thereby accommodating different discharge lamps.

Once the lamp LP1 is struck successfully, the sensing circuit 120 detects the presence of the lamp current $I_{LP}$ and turns on the transistor Q2. Thus, the node A is electrically coupled to ground such that the transistor Q1 is held on to continue providing the start signal of logic "0". Due to the feedback lamp current $I_{LP}$, the drive circuitry 110 decreases its output from the strike voltage to normal operating voltage for the lamp LP1. If the discharge lamp circuit 100 is turned on without the lamp LP1 being in place, or if the lamp LP1 becomes disconnected during normal operation due to a failure, the sensing circuit 120 detects the absence of the lamp current $I_{LP}$ and turns off the transistor Q2. This allows the capacitor C1 to be charged so that the node voltage $V_A$ rises to $V_{REF}$ at the end of the period $T_{ON}$. The voltage difference $V_{B1}-V_A$ is insufficient at this time to allow the transistor Q1 in the saturation and turn it off eventually. Hence, the collector of Q1 produces the start signal S of logic 1 to shut down the drive circuitry 110 thereby preventing the occurrence of the overvoltage condition.

As shown in FIG. 2, the PNP transistor Q3 and its associated voltage divider of R4 and R5 are employed to discharge the capacitor C1 rapidly. The resistors R4 and R5 divide the ON/OFF signal's voltage into a voltage $V_{B2}$ at the base of Q3. Obviously, the PNP transistor Q3 is turned off when the ON/OFF signal is at the logic high level. When the drive circuitry 110 is powered off, the ON/OFF signal goes to the logic low level causing the voltage $V_{B2}$ to turn on the PNP transistor Q3. In this way, the PNP transistor Q3 in conduction forms a shortcut to remove electrical charges from the capacitor C1 quickly upon the drive circuitry 110 shutdown.

Accordingly, the discharge lamp circuit of the invention controls the ignition time for different discharge lamps by adjusting the values of the resistor R7 and the capacitor C1 in the timing circuit 130. In addition, when a backlight module is powered on without a discharge lamp being in place, or when a discharge lamp becomes disconnected during normal operation due to a failure, the start-up circuit 140 can shut down the drive circuitry 110 to provide overvoltage protection.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A discharge lamp circuit for ignition time control and overvoltage protection, comprising:

drive circuitry for producing a strike voltage for a discharge lamp and providing a lamp current through the discharge lamp;

a sensing circuit for detecting the lamp current;

a timing circuit, controlled by the sensing circuit, for developing a threshold voltage at an end of a predetermined period, thereby controlling an ignition time of the drive circuitry; and a start-up circuit for allowing the drive circuitry to keep on applying the strike voltage for the ignition time in order to start the discharge lamp before the threshold voltage is developed, and for causing the drive circuitry shutdown if the sensing circuit detects an absence of the lamp current.

2. The discharge lamp circuit as recited in claim 1, wherein the timing circuit comprises a capacitor coupled to a resistor at a node where a node voltage is developed, in which the predetermined period is determined by the capacitor's value and the resistor's value and the node voltage reaches the threshold voltage at the end of the predetermined period.

3. The discharge lamp circuit as recited in claim 2 wherein the start-up circuit comprises a first switch coupled to the node of the timing circuit, receiving an input signal, and generating a start signal at a first level to activate the drive circuitry when a voltage difference between the input signal and the node voltage is sufficient to turn on the first switch.

4. The discharge lamp circuit as recited in claim 3 wherein the sensing circuit comprises a second switch coupled to the capacitor, when the sensing circuit detects the presence of the lamp current, the second switch is turned on to discharge the capacitor.

5. The discharge lamp circuit as recited in claim 4 wherein the second switch is turned off when the sensing circuit detects the absence of the lamp current, thereby allowing the capacitor to be charged so that the node voltage reaches the threshold voltage at the end of a predetermined period.

6. The discharge lamp circuit as recited in claim 5 wherein the start-up circuit generates the start signal at a second level to shut down the drive circuitry when the second switch is turned off, causing the first switch to be turned off.

7. The discharge lamp circuit as recited in claim 6 wherein the start-up circuit further comprises a third switch coupled to the capacitor, for discharging the capacitor quickly upon the drive circuitry shutdown.

8. A discharge lamp circuit for ignition time control and overvoltage protection, comprising:

drive circuitry for producing a strike voltage for a discharge lamp and providing a lamp current through the discharge lamp;

a sensing circuit coupled to the discharge lamp, for detecting the lamp current;

a timing circuit for developing a threshold voltage at an end of a predetermined period, comprising:

a resistor; and a capacitor coupled to the sensing circuit and coupled to the resistor at a node where a node voltage is developed;

wherein the node voltage reaches the threshold voltage at the end of the predetermined period determined by the capacitor's value and the resistor's value, thereby controlling an ignition time of the drive circuitry; and a start-up circuit comprising a first transistor coupled to the node of the timing circuit, wherein the first transistor is in a first state before the node voltage is developed into the threshold voltage thereby allowing the drive circuitry to keep on applying the strike voltage for the ignition time in order to start the discharge lamp, and the first transistor is in a second state when the sensing circuit detects an absence of the lamp current and the threshold voltage is developed at the end of the predetermined period.

9. The discharge lamp circuit as recited in claim 8 wherein the start-up circuit receives an input signal and generates a start signal at a first level to activate the drive circuitry when a voltage difference between the input signal and the node voltage is sufficient to drive the first transistor into the first state.

10. The discharge lamp circuit as recited in claim 9 wherein the sensing circuit comprises a second transistor coupled to the capacitor, when the sensing circuit detects the presence of the lamp current, the second transistor being in the first state to discharge the capacitor.

11. The discharge lamp circuit as recited in claim 10 wherein the second transistor enters the second state when the sensing circuit detects the absence of the lamp current, thereby allowing the capacitor to be charged so that the node voltage reaches the threshold voltage at the end of a predetermined period.

12. The discharge lamp circuit as recited in claim 11 wherein the start-up circuit generates the start signal at a second level to shut down the drive circuitry when the voltage difference drives the first transistor into the second state for the second transistor being in the second state.

13. The discharge lamp circuit as recited in claim 12 wherein the start-up circuit further comprises a third transistor coupled to the capacitor, for discharging the capacitor quickly upon the drive circuitry shutdown.

14. A display having functions of ignition time control and overvoltage protection, comprising:

a discharge lamp; and a discharge lamp circuit coupled to the discharge lamp, comprising:

drive circuitry for producing a strike voltage for the discharge lamp and providing a lamp current through the discharge lamp;

a sensing circuit for detecting the lamp current;

a timing circuit, controlled by the sensing circuit, for developing a threshold voltage at an end of a predetermined period, thereby controlling an ignition time of the drive circuitry; and a start-up circuit for allowing the drive circuitry to keep on applying the strike voltage for the ignition time in order to start the discharge lamp before the threshold voltage is developed, and for causing the drive circuitry shutdown if the sensing circuit detects an absence of the lamp current.

15. The display as recited in claim 14, wherein the timing circuit comprises a capacitor coupled to a resistor at a node where a node voltage is developed, in which the predetermined period is determined by the capacitor's value and the resistor's value and the node voltage reaches the threshold voltage at the end of the predetermined period.

16. The display as recited in claim 15 wherein the start-up circuit comprises a first switch coupled to the node of the timing circuit, receiving an input signal, and generating a start signal at a first level to activate the drive circuitry when a voltage difference between the input signal and the node voltage is sufficient to turn on the first switch.

17. The display as recited in claim 16 wherein the sensing circuit comprises a second switch coupled to the capacitor, when the sensing circuit detects the presence of the lamp current, the second switch is turned on to discharge the capacitor.

18. The display as recited in claim 17 wherein the second switch is turned off when the sensing circuit detects the absence of the lamp current, thereby allowing the capacitor to be charged so that the node voltage reaches the threshold voltage at the end of a predetermined period.

19. The display as recited in claim 18 wherein the start-up circuit generates the start signal at a second level to shut down the drive circuitry when the second switch is turned off, causing the voltage difference to turn off the first switch.

20. The display as recited in claim 19 wherein the start-up circuit further comprises a third switch coupled to the capacitor, for discharging the capacitor quickly upon the drive circuitry shutdown.

* * * * *